United States Patent [19]

Farley

[11] Patent Number: 4,485,962

[45] Date of Patent: Dec. 4, 1984

[54] COMPARTMENTALIZED FILE FOLDER APPARATUS

[76] Inventor: Maryette K. Farley, 1908 Harvard Ave., Metairie, La. 70001

[21] Appl. No.: 431,342

[22] Filed: Sep. 30, 1982

[51] Int. Cl.[3] ..... B65D 27/08

[52] U.S. Cl. ..... 299/1.5 R; 229/72

[58] Field of Search ..... 229/1.5 R, 72, 68 R

[56] References Cited

U.S. PATENT DOCUMENTS

| | | | |
|---|---|---|---|
| 884,019 | 4/1908 | Herdegen | 229/72 |
| 1,564,557 | 12/1925 | Greenhaus | 229/72 |
| 1,722,911 | 7/1929 | Greenhaus | 229/68 R |
| 1,743,305 | 1/1930 | Banks | 229/1.5 R |
| 1,759,255 | 5/1930 | Greenhaus | 229/68 R |
| 1,794,560 | 3/1931 | Styll | 229/1.5 R |
| 2,222,443 | 11/1940 | Rubins | 229/72 |
| 2,274,909 | 3/1942 | Murray | 229/68 R |
| 2,390,864 | 12/1945 | Bayley | 229/72 |
| 3,826,422 | 7/1974 | Dickinson | 229/68 R |
| 3,933,294 | 1/1976 | Meenan et al. | 229/1.5 R |

*Primary Examiner*—Stephen P. Garbe

*Attorney, Agent, or Firm*—Bode & Smith

[57] ABSTRACT

A compartmentalized file folder having a first expandable and sealable pocket mounted on the inner side of the folder wall and a second expandable pocket mounted on the wall of the first pocket for retaining items of smaller size.

5 Claims, 2 Drawing Figures

COMPARTMENTALIZED FILE FOLDER APPARATUS

BACKGROUND OF THE INVENTION

1. Field of the Invention

The present invention relates to file folders. In particular, the present invention relates to a new and useful compartmentalized file folder apparatus.

2. General Background

Present file folders provide means for collecting and keeping correspondence and papers related to specific subjects or clients so the papers are easily retrieved by pulling the appropraite folder from a filing cabinet. But the present folders do not provide a means for separate storage and easy retrieval of items that are smaller than the standard letter or legal sized papers such as time slips, message slips, photographs and the like.

GENERAL DISCUSSION OF THE PRESENT INVENTION

According to this invention, the inside of a file folder made of a heavy paper material such as heavy manilla bond would have an expandable pocket that is integrally attached to one side of the folder. The expandable pocket is positioned inside the folder in such a manner that the opening of the pocket is farthest away from the crease of the file folder itself and is parralel to the crease. This provides for easy access to the expandable pocket when the file folder is open. Smaller items such as time slips, message slips or photographs are easily inserted and readily retrieved from the folder without the inconvenience of leafing through standard sized papers and the entire file as is necessary with present file folders. The easy access results in more organized files and increased office efficiency.

The expandable pocket could be opened or it could have some means for securing its opening, such as a flap secured by string in its closed position to prevent the items placed in it from falling out and becoming lost or mixed with the rest of the file papers.

Also, the expandable pocket could be used where a second smaller pocket is included as part of the first expandable pocket. The second pocket would be placed at one end of the expandable pocket with its opening being perpendicular to that of the expandable pocket and facing away from the end on which the second pocket is attached.

Therefore, it is an object of this invention to provide a means for separate storage and easy retrieval of such smaller items.

It is also an object of the present invention to provide a means for increased office efficiency by providing a means for more organized files.

DETAILED DESCRIPTION OF THE PREFERRED EMBODIMENT

Figure 1:
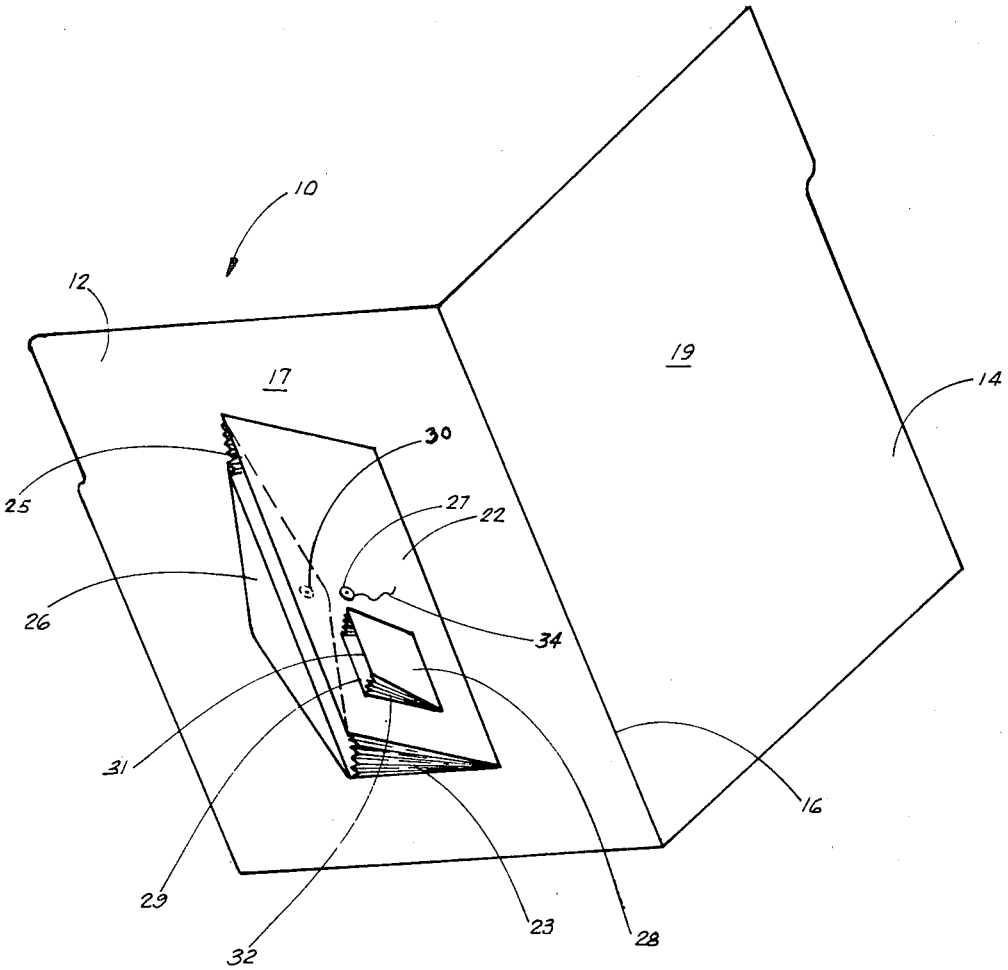
FIG. 1 is a perspective view of the preferred embodiment of the apparatus of the present invention illustrating the apparatus in the opened position with expandable compartmentalized pockets attached thereto.

FIG. 1 illustrates in perspective view the preferred embodiment of the apparatus of the present invention as illustrated by the numeral 10. In FIG. 1 there is illustrated folder 10 in the open position having a first side portion 12 and a second side portion 14 joined at a common crease along their length at 16. Crease 16 would substantially divide the folder 10 in two halves, allowing folder 10 to be placed in the closed position with the inside walls 17 and 19 of side portions 12 and 14 adjacent one another.

There is further provided on at least one inside wall 17 of side portion 12, a first expandable pocket 22, which may be attached to side 12 (or 14) by gluing or may be integrally attached, in the preferred embodiment, with the expandable pocket 22 having an opening substantially along its length at 25, preferably with the opening distal to crease 16. As is illustrated in FIG. 1, expandable pocket 22 is expandable along its side edge 23, so that numerous items may be placed therein for containment. Expandable pocket 22 is further provided with a flap 26 integrally attached in the preferred embodiment along its length at 25 to inside wall 17 of side portion 12, which is a flap or the like for extending over the opening of first expandable pocket 22, for sealing the containments therein. Closure of flap 26 and thus expandable pocket 22 is accomplished through the use of disks 27, 30 and cord 34. Disks 27, 30 have their central portions secured to expandable pocket 22 and flap 26 respectively. A cord 34 is fixedly attached to pocket 22 under disk 27 and is adapted to engage under disk 30 and under disk 27 for detachably securing flap 26 to pocket 22. Flap 26 is illustrated in phantom view in its closed position in FIGS. 1 and 2.

As is further illustrated in FIG. 1, there is also mounted on the outer edge of expandable pocket 22 a second expandable pocket 28, which as is illustrated in FIG. 1, is a substantially smaller pocket, also having an opening 29 along its side edge 31 for slipping items therein, but in the preferred embodiment, opening 29 having no enclosure means. Expandable pocket 28 would be attached to pocket 22 via gluing or the like or integrally attached to expandable pocket 22 and expandable along edge 32.

Because expandable pocket 22 is provided with an opening distal to the crease of folder 10, the items therein would remain within upon the opening and closing of folder 22. Likewise, the opening 29 of smaller expandable pocket 28 would be positioned substantially parallel to the opening at 25 of larger expandable pocket 22, so that those items contained therein are easily retrievable.

Figure 2:
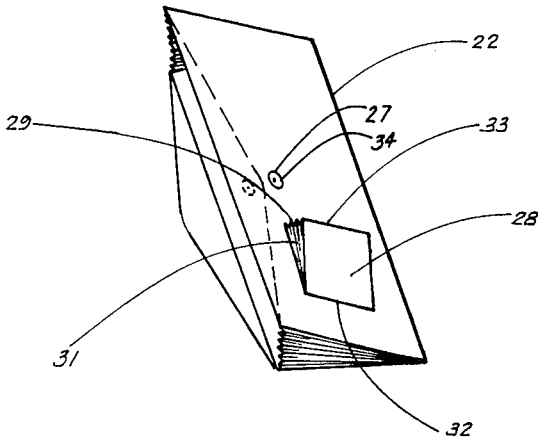
FIG. 2 is a view of the alternative embodiment of the pocket means of the apparatus of the present invention.

FIG. 2 illustrates an alternate embodiment of expandable pocket 28 mounted on pocket 22, providing an opening 29 along top edge 33, and expandable along side edge 31.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A compartmentalized file folder, comprising:

a. first and second side portions, integrally attached to one another substantially along their length, and foldable along a common crease between opened and closed positions and defining inside and outside walls of said first and second side portions;

b. a first pocket attached to the inside of at least one of said side portions, said first pocket having at least one opening positioned distal said common crease; and c. a second pocket mounted upon said first pocket, having an opening substantially perpendicular to said opening of said first pocket.

2. The apparatus in claim 1, further comprising means for securing said first pocket in a closed position.

3. The apparatus in claim 2, wherein said means for securing said first pocket in said closed position comprises a flap attached to said first pocket.

4. The apparatus of claim 1, wherein said first and second pocket are expandable.

5. A compartmentalized file folder, comprising:

a. first and second side portions, integrally attached to one another substantially along their length, and foldable along a common crease between opened and closed positions and defining inside and outside walls of said first and second side portions;

b. a first sealable and expandable pocket substantially smaller than said side portions mounted upon the inside of at least one of said side portions, having an opening substantially parallel and distal to said common crease; and c. a second open-ended expandable pocket mounted upon said first pocket, having an opening substantially perpendicular to said opening of said first pocket.

* * * * *